US006410855B1

(12) United States Patent
Berkowitz et al.

(10) Patent No.: US 6,410,855 B1
(45) Date of Patent: Jun. 25, 2002

(54) CABLE MANAGER FOR TABLE

(75) Inventors: Rick Berkowitz; Elliott W. Baum, both of St. Louis County; Lucian N. Chirea, St. Louis, all of MO (US)

(73) Assignee: Berco Tableworks Ltd., St. Louis, MO (US)

( * ) Notice: Subject to any disclaimer, the term of this patent is extended or adjusted under 35 U.S.C. 154(b) by 0 days.

(21) Appl. No.: 09/494,473

(22) Filed: Jan. 31, 2000

(51) Int. Cl.[7] ..... H02G 3/00

(52) U.S. Cl. ..... 174/101; 174/48; 174/72 A; 174/68.1; 361/826; 248/49; 108/50.02

(58) Field of Search ..... 174/101, 48, 72 A, 174/70 R, 99 R, 68.1; 248/58, 49; 312/223.1, 223.2, 223.3, 223.6; 220/334, 335, 337; 361/826; 108/50.02

(56) References Cited

U.S. PATENT DOCUMENTS

| | | | | |
|---|---|---|---|---|
| 4,406,379 A | | 9/1983 | Anderson et al. | 220/335 |
| 4,862,659 A | * | 9/1989 | Wilson et al. | 52/221 |
| 5,091,607 A | * | 2/1992 | Stob | 174/48 |
| 5,231,562 A | | 7/1993 | Pierce et al. | 361/428 |
| D378,731 S | | 4/1997 | Kopish | D8/356 |
| 5,640,912 A | | 6/1997 | Diffrient | 108/50 |
| D389,034 S | | 1/1998 | Lewis | D8/356 |
| 5,815,894 A | * | 10/1998 | Soriano | 24/510 |
| D401,224 S | | 11/1998 | Mollenkopf et al. | D13/155 |
| 5,934,203 A | | 8/1999 | Glass | 108/156 |
| 5,971,508 A | | 10/1999 | Deimen et al. | 312/223.6 |
| 6,192,805 B1 | * | 2/2001 | Saylor et al. | 108/26 |
| 6,211,460 B1 | * | 4/2001 | Hull et al. | 174/48 |
| 6,235,988 B1 | * | 5/2001 | Karst et al. | 174/48 |

OTHER PUBLICATIONS

Spec Furniture Brochure, Printed in Canada No Date.
Cabletray with Powerway–Table Cable 1996.
Johnson Tables, Seminar/Training No Date.
Falcon/Mats, Multiple Application Table System No Date.
Tutor Table System No Date.
Versteel, PowerLink, No Date.
PowerTrack and Power House No Date.

* cited by examiner

*Primary Examiner*—Dean A. Reichard
*Assistant Examiner*—W. David Walkenhorst
(74) *Attorney, Agent, or Firm*—Paul M. Denko

(57) ABSTRACT

A cable manager for mounting to the front edge of a table to secure and organize electrical cables associated with electronic devices, such as computer equipment, resting on the table. One embodiment of the novel cable organizer includes a modesty panel which has an integral bead retention channel extending the length of the top edge and a bead retention channel extending the length of the bottom edge and mounting brackets engaged in the top bead retention. The modesty panel includes a slide lock assembly extending outwardly from the back side. A substantially U-shaped cable containment channel is slidingly engaged in the slide lock assembly and the bottom bead retention channel. Another embodiment includes a raceway having a bottom wall, a rear wall and opposed end walls, the end walls each have aligned and complementary openings for the introduction of electrical cables into the raceway. A torsion spring biased hinge along the front edge of the raceway bottom wall is attached to a modesty panel which serves as a door to allow access to the cables in the raceway.

15 Claims, 10 Drawing Sheets

CABLE MANAGER FOR TABLE

CROSS-REFERENCE TO RELATED APPLICATIONS

None

BACKGROUND OF THE INVENTION

This invention relates generally to work tables which support computers and the like and, more particularly to a novel wire and cable manager which attaches to the work table to support, house or conceal electrical power and data cables required by the computers.

Personal computer systems are employed extensively for business, education and home use. Generally speaking, these computer systems consist of a central processing unit, a monitor or screen, a key board and a printer. In most cases, and particularly in business applications, the computer system is placed upon a support surface such as a desk or a table. Often in schools, training centers or word processing pools, a plurality of personal computers are provided in a series along one or more tables, for example. Each component of a personal computing system generally is connected to an electric power source. That is, the computer must be plugged into an electric outlet. Each computer or other component, such as a printer, has its own electric cord or there is a master power supply cord or wire accessible to each individual computer. Furthermore, there may be connections to the Internet provided for each computer. When a series of computers are aligned along the length of a table for several users, for example in a computer laboratory or classroom setting, multiple power cables and data cables are connected to the computer components and may simply hang over the back edge of the table or desk. These cords and cables can become tangled or, in some situations, create a hazard for persons moving about between tables. Furthermore, such an arrangement is unattractive to the eye.

It would be advantageous, therefore, to have an apparatus which can be mounted to the table which could contain, and thereby organize or shield from view, all of the power cables and other cords which ordinarily are left exposed.

SUMMARY OF THE INVENTION

It is among the several objects of the present invention to provide a cable manager for mounting to the edge of a table for the containment and organization of power cables and the like.

It is another object of the present invention to provide such a cable manager that combines a modesty panel and a trough for containing and organizing the power cables and the like.

It is another object of the present invention to provide such a cable manager wherein the primary components are constructed from extruded metal.

It is another object of the present invention to provide such a cable manager wherein the primary components can be easily and economically constructed in any desired length so as to be usable with tables of various lengths.

It is still another object of the present invention to provide such a cable manager wherein the primary components are interchangeable.

It is further object of the present invention to provide such a cable manager that provides easy access to the electrical cables housed therein.

It is still another object of the present invention to provide such a cable manager wherein the cables can be housed in a raceway and the modesty panel functions as a door to allow access to the cables therein.

Briefly stated, the present invention provides for a cable manager which can be mounted to the front edge, or back edge, of a table to secure and organize electrical cables associated with electronic devices, such as computer equipment, resting on the table. One embodiment of the novel cable manager includes a modesty panel of extruded aluminum. The modesty panel includes an integral bead retention channel extending the length of the top edge and a bead retention channel extending the length of the bottom edge. At least one mounting bracket is engaged in the top bead retention for releaseably mounting the cable manager to a table. The modesty panel includes a slide lock assembly extending outwardly from the back side. The slide lock assembly is comprised of a pair of outwardly disposed spaced apart flanges which extend the length of the panel. A substantially U-shaped cable containment trough is slidingly engaged in the slide lock assembly and the bottom bead retention channel. The modesty panel includes cast metal end caps at each end.

In another preferred embodiment, the cable manager includes a raceway having a bottom wall, a rear wall and opposed end walls. The end walls each have at least one opening formed therein, the openings being aligned and complementary for the introduction of electrical cables into the raceway. There is a spring-biased hinge along the front edge of the raceway bottom wall. A modesty panel is attached to the raceway via the hinge. The modesty panel serves as a door to allow access to the cables in the raceway. In both embodiments the primary components are formed from extruded aluminum.

BRIEF DESCRIPTION OF THE DRAWINGS

Corresponding reference numerals indicate corresponding elements throughout the various figures.

DESCRIPTION OF THE PREFERRED EMBODIMENT

Figure 1:
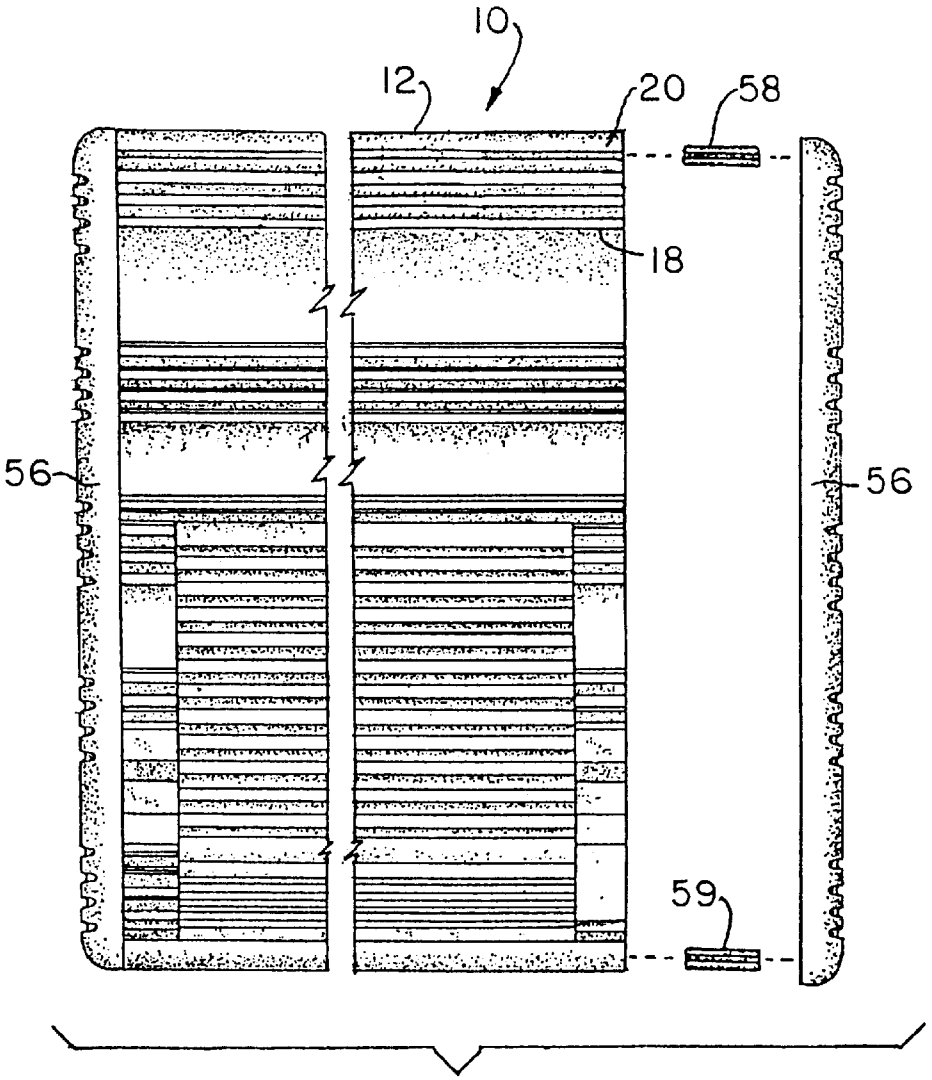
FIG. 1 is a partially exploded, front elevational view of one embodiment of the cable manager of the present invention.
Figure 2:
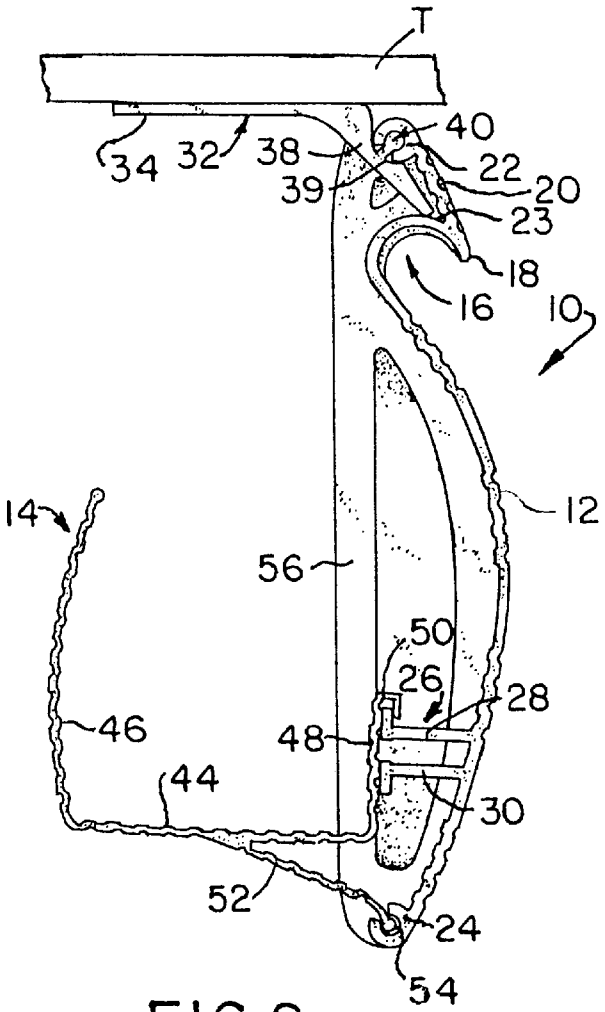
FIG. 2 is an enlarged side elevational view of the cable manager of FIG. 1.
Figure 3:
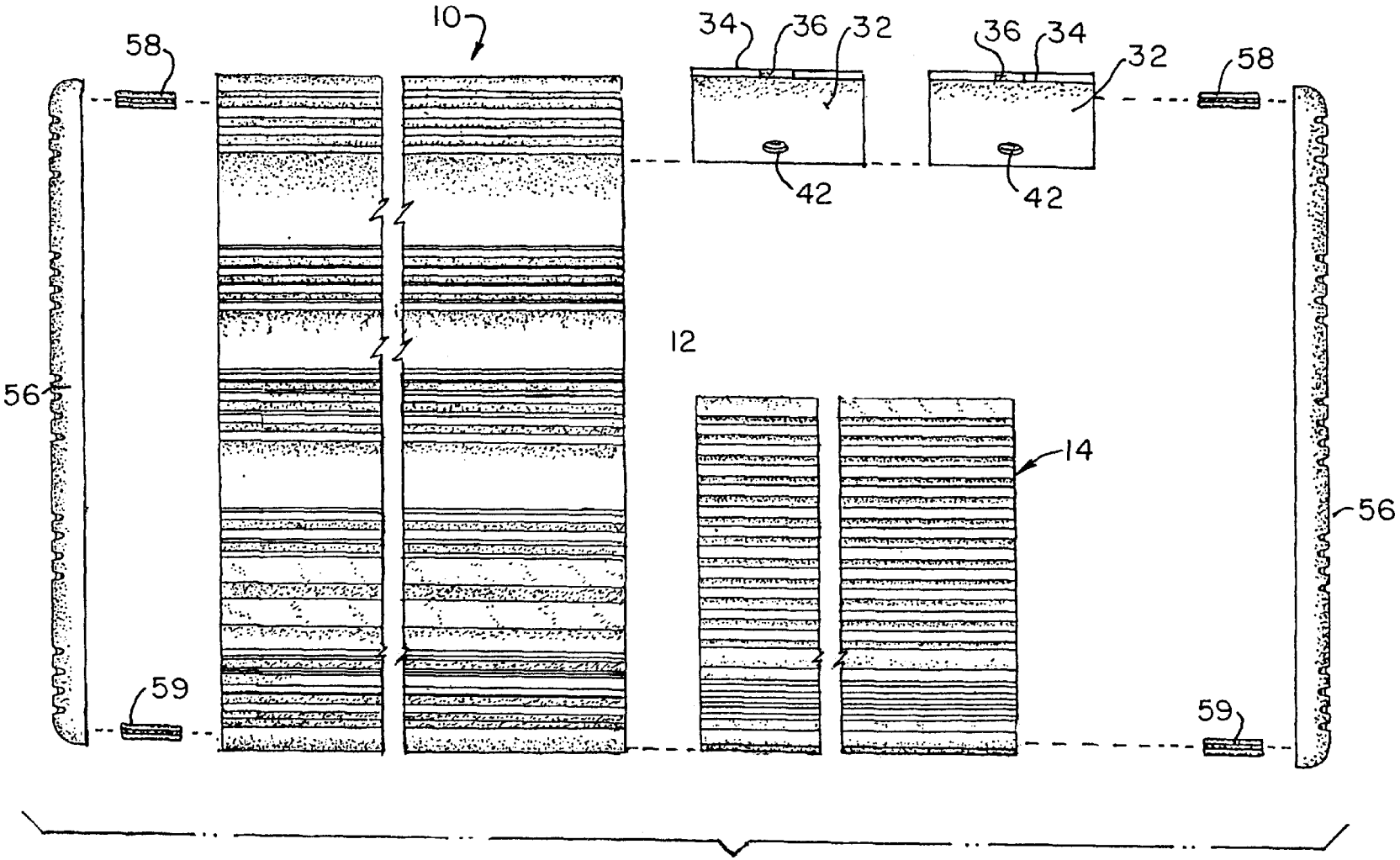
FIG. 3. Is a front exploded view thereof.
Figure 4:
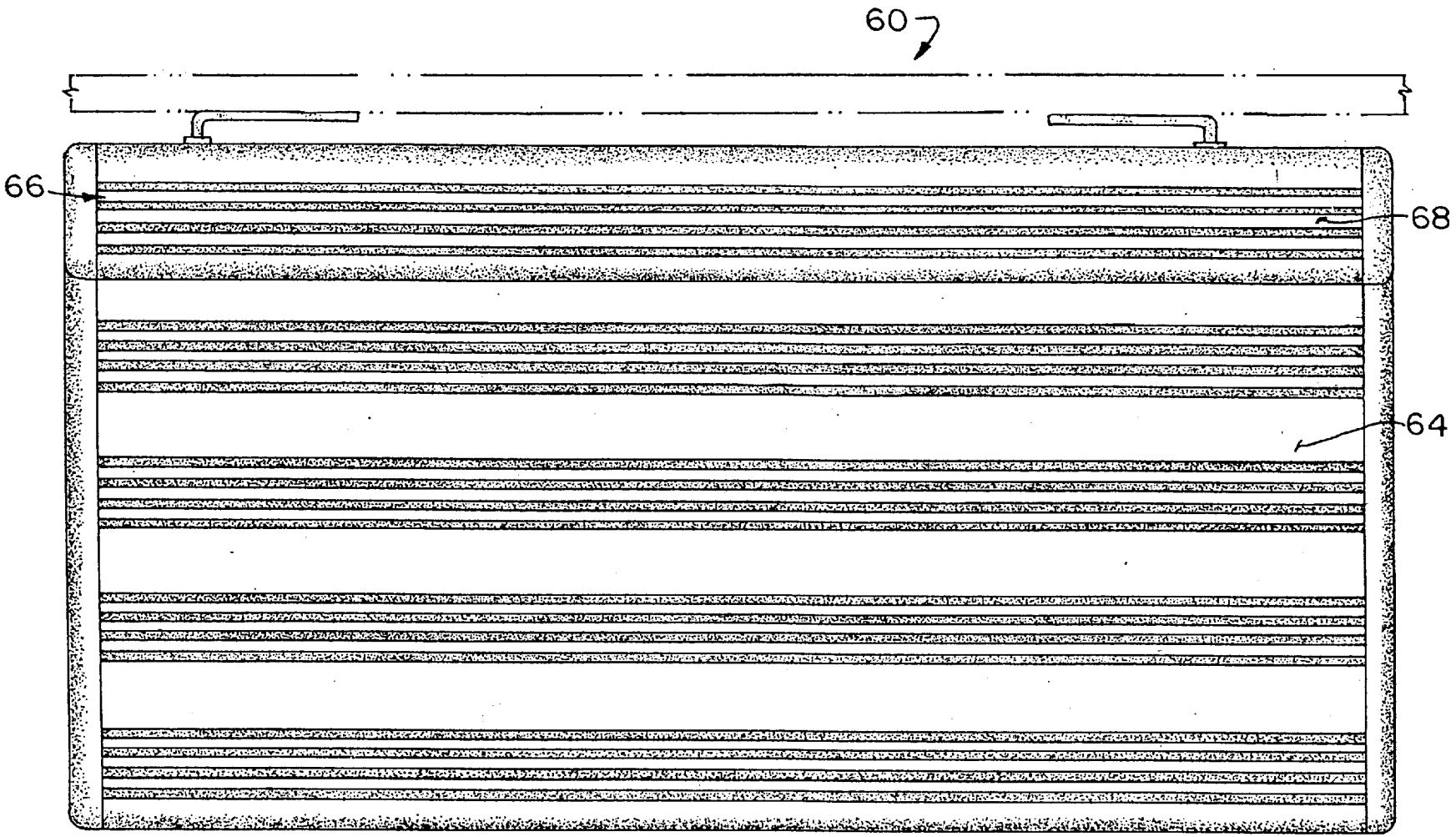
FIG. 4 is a front elevational view of another embodiment of the cable manager of the present invention.
Figure 5:
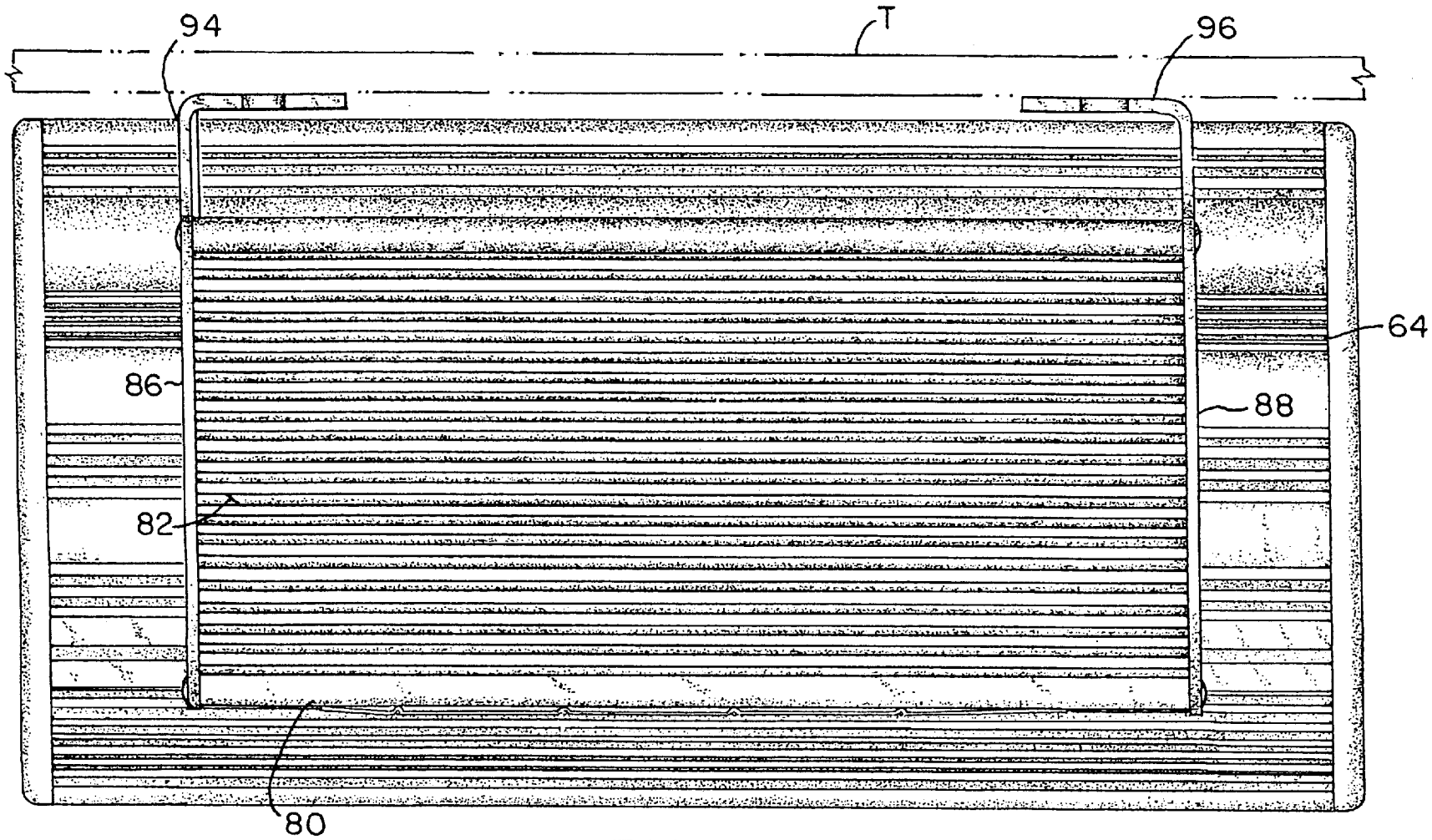
FIG. 5 is a rear elevational view thereof.
Figure 6:
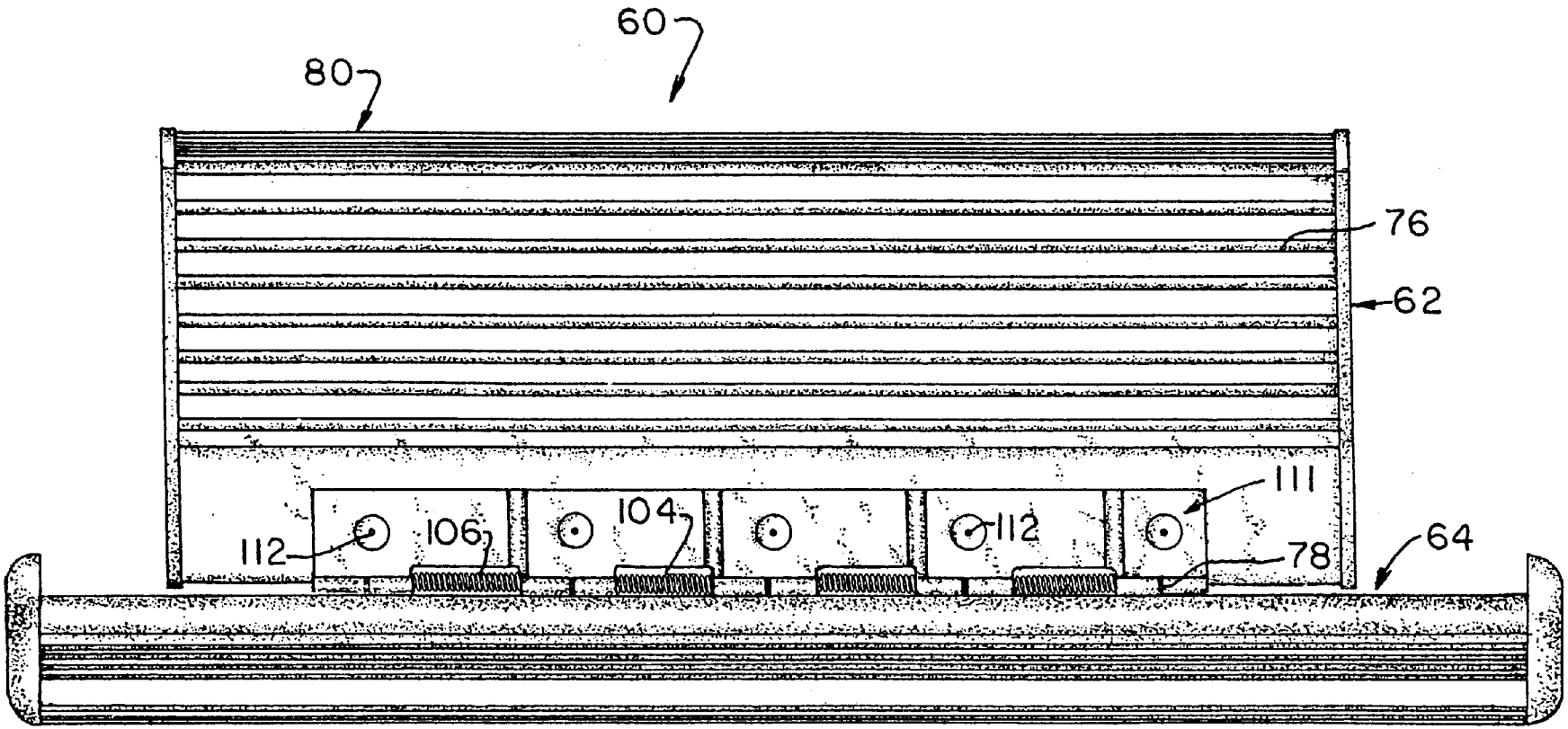
FIG. 6 is a bottom plan view thereof.

A cable manager of the present invention is indicated generally by reference numeral 10 in FIGS. 1–3. Cable manager 10 includes a panel 12, generally referred to as a modesty panel, and a cable containment trough 14. Panel 12 and trough 14 can be formed, preferably as extruded aluminum, in any desired lengths, depending upon the length of the table T to which it will be attached. Panel 12 has a general arcuate profile with a recurve section 16 adjacent the top edge which forms an overhang 18. It will be appreciated that the overhang 18 can function a handle to allow the user to grasp the manager for installation and/or removal. Further, as will be described below with reference to the embodiments of FIGS. 4–9, overhang 18 can function as a handle when the panel is employed as a door to a raceway. Overhang 18 includes an inwardly and upwardly angled upper segment 20 which terminates in a substantially circular bead retention channel 22. The intersection of segment 20 and the overhang 18 form a crease 23. The bottom edge of panel 12 terminates in a lower or bottom substantially circular bead retention channel 24.

As best seen in FIG. 3, the back side of panel 12 includes an integral slide lock assembly, indicated generally as numeral 26. Slide lock assembly 26 includes a first of upper outwardly directed flange 28 and a spaced apart, second or lower outwardly directed flange 30. It will be appreciated that the respective flanges are formed in the extrusion process and run the entire horizontal length of the panel 12.

Cable mananger 10 includes one or more mounting brackets, as at 32. The mounting bracket 32 has a body 34 with an open-ended slot 36 for attachment with appropriate hardware to the bottom side of a table. Mounting bracket 32 also includes downwardly and outwardly angled forward wall 38 having an arcuate recess 39 from which protrudes a bead 40. It will be appreciated that the bead 40 extends the width of the bracket. When assembled bead 40 engages bead retention channel 22 and the bottom of wall 38 engages crease 23 in a sliding arrangement which allows the brackets to be position at a desired located along the length of the cable manager. There is a set screw opening 42 formed in wall 38 for the threaded engagement of a set screw (not shown) to lock the bracket in place.

Cable containment trough 14 is best illustrated in FIG. 2. Trough 14 has a bottom wall 44, an integral rear wall 46 and a shorter front wall 48. Front wall 48, terminates in a channel 50. An angled brace 52 extends downwardly from bottom wall 44 and terminates in bead 54. When assembled, channel 50 engages top flange 28 of the slide lock assembly and bead 54 engages channel 24. As will be appreciated by those skilled in the art, trough 14 is installed on panel 12 by appropriately aligning the parts and sliding the channel onto the panel. Each end of panel 12 is finished with an end cap as at 56 which is held in place by pins 58 and 59 which engage channels 22 and 24 respectively. End caps 56 are generally constructed as cast metal such as cast aluminum. It will be appreciated that the extruded aluminum parts can be powder coated with aesthetically pleasing colors. Moreover, it will be appreciated that the manager 10 can be installed on a table with the modesty panel 12 facing outward or reversed so that the panel faces under the table thereby exposing trough 14 to the outside for ease of access to cables or wires housed in trough 14.

Figure 9:
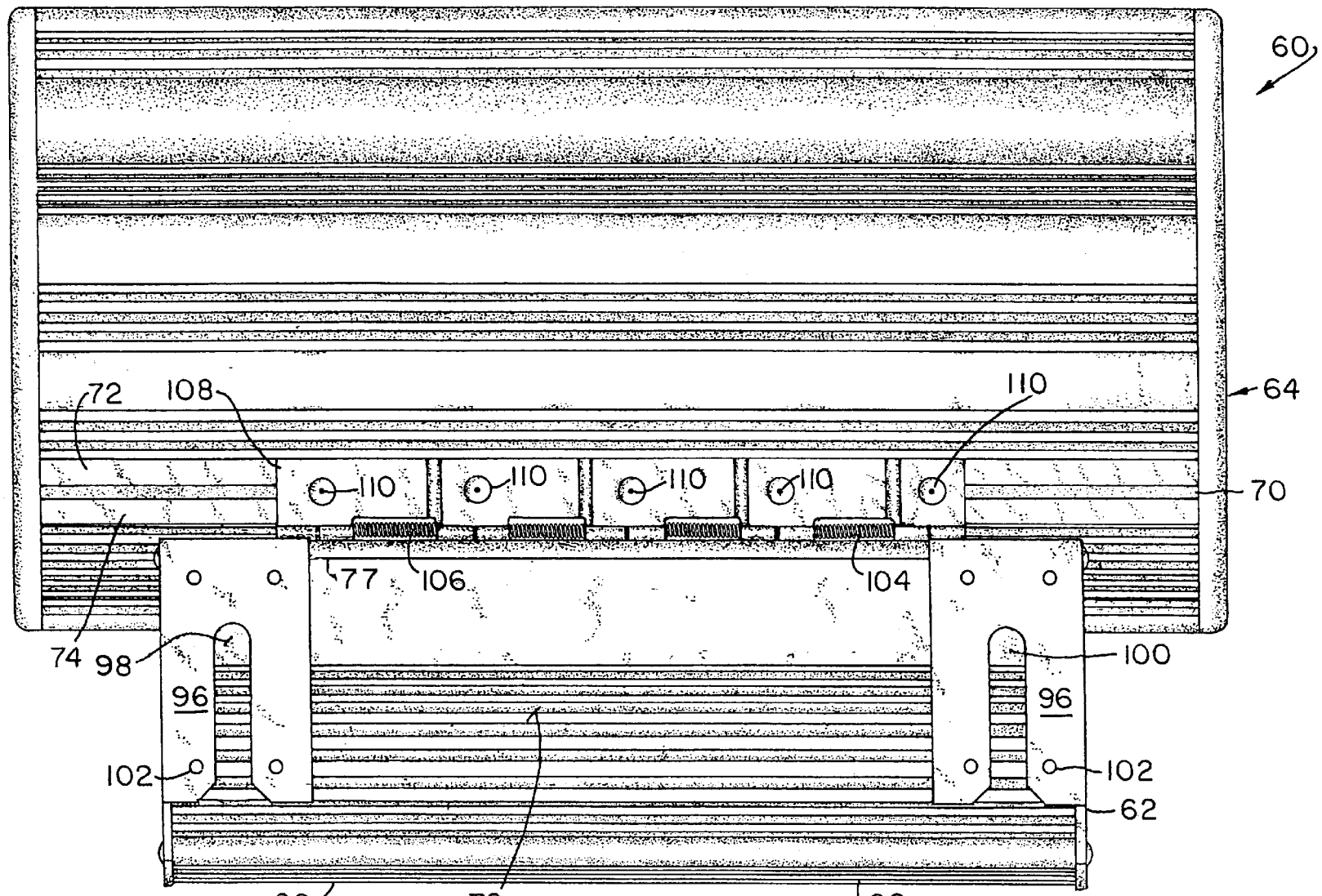
FIG. 9 is a top plan view thereof, the modesty panel in an open position.

Another preferred embodiment of the cable manager is illustrated in FIGS. 4–9 and is indicated generally by reference numeral 60. Cable manager 60 includes a raceway 62 and a modesty panel 64. Panel 64 has the same general construction as the previously described panel 12. It will be appreciated that panel 64 serves both as a modesty panel and as a door to the raceway 62, as will be explained. Panel 64 has a general arcuate profile with a recurve section 66 adjacent the top edge which forms an overhang 68. In this particular embodiment the overhang 68 can functions primarily as a to facilitate access to the raceway 62 as will be described below. As best seen in FIG. 9, the back side of panel 62 includes a slide lock assembly, indicated generally as numeral 70. Slide lock assembly 70 has the same configuration as slide lock 26 previously described and includes a first of upper outwardly directed flange 72 and a spaced apart, second or lower outwardly directed flange 74. It will be appreciated that the respective flanges are formed in the extrusion process and run the entire horizontal length of the panel 64. A will be appreciated by those skilled in the art, the respective panels 12 and 64 can be used interchangeably between the cable manager 10 and cable manager 60, thereby increasing the versatility of the novel design.

Raceway 62 is best illustrated in FIGS. 5–9. Raceway 62 includes a bottom wall 76 having a front edge 78 and a rear edge 80. An integral rear wall 82 extends upwardly from rear edge 80 of the bottom wall 76. Raceway 62 also can contain an inner cable duct 84 for the containment of smaller gauge electrical cables and sources of power. Raceway 62 includes a first end wall 86 and a second end wall 88 and an open front side 87 which is disposed towards panel 64. It will be appreciated that the respective end walls are mirror images of each other. The end walls are attached to the raceway bottom and rear walls by rivets 65 or other conventional attachment devices. The end walls each include a first opening 90 which is an open-ended downwardly angled slot section 90A terminating a substantially circular segment 90B. It will be appreciated that open-ended slot section 90A allows the introduction of a relatively large gauge of cable or wire which can be slid down the slot and positioned in the circular segment 90B. Furthermore, the end walls can include similarly configured, but smaller, aligned and complementary openings 92 formed therein which function as wire guides through the wall for the introduction of smaller gauge electrical cables into inner wire duct inside the raceway. It will be appreciated that the respective openings 90 and 92 allow for the ingress and egress of cables or wires housed in the raceway through the end walls so that the cables or wires can enter, and be contained in, adjacent wire managers where multiple wire managers my be employed in series. This novel structure also allows for the exposure of the ends wires and cables to be connected to a power source.

Figure 7:
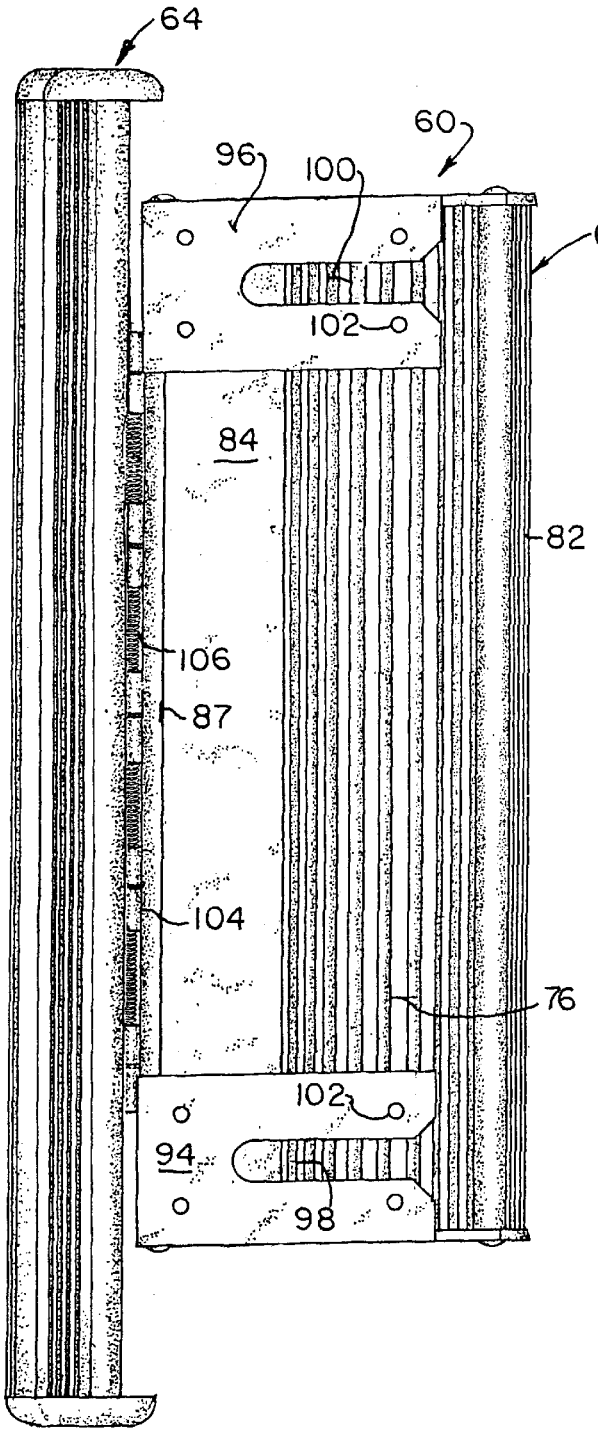
FIG. 7 is a top plan view thereof, the modesty panel in a closed position.
Figure 8:
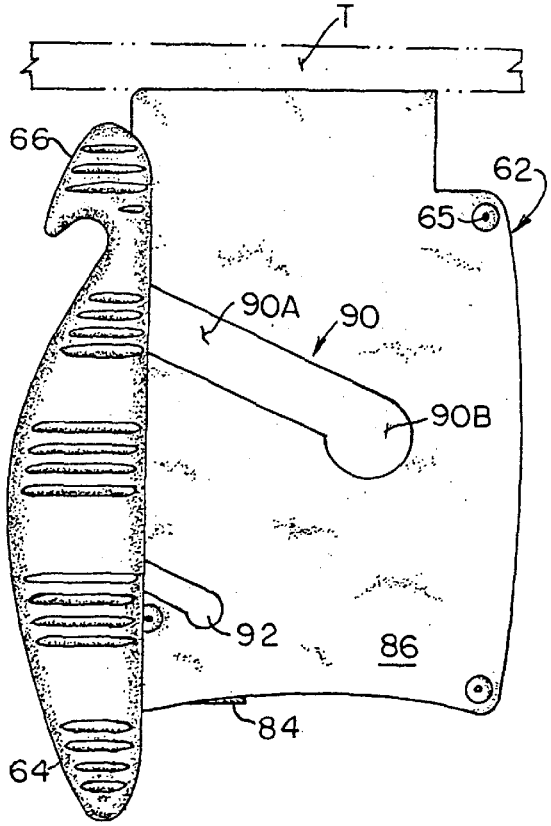
FIG. 8 is an end plan view thereof.

As best seen in FIGS. 7 and 9, the side walls 86 and 88 have integral attachment brackets 94 and 96 on an upper edge. The brackets can be integrally formed when the end walls are stamped out of metal and the bent over to form a bracket that will be parallel to the table top. The brackets 94 and 96 include slots 98 and 100 respectively for the removable mounting of the manager to the underside of a table T, for example. Each bracket includes a plurality of holes as at 102 in the event the user wants to attach the brackets with screws (not shown).

The panel 64 is attached to the raceway 62 by a spring loaded hinge 104. As can be seen, the hinge 104 has the overall configuration of a piano hinge but includes a torsion spring 106. A first wing 108 of the hinge is attached to the slide lock assembly 70 by a plurality of rivets 110 or other appropriate attachment means. The second wing 111 of the hinge is attached at the front edge 78 of bottom wall 76 by rivets 112.

Figure 10:
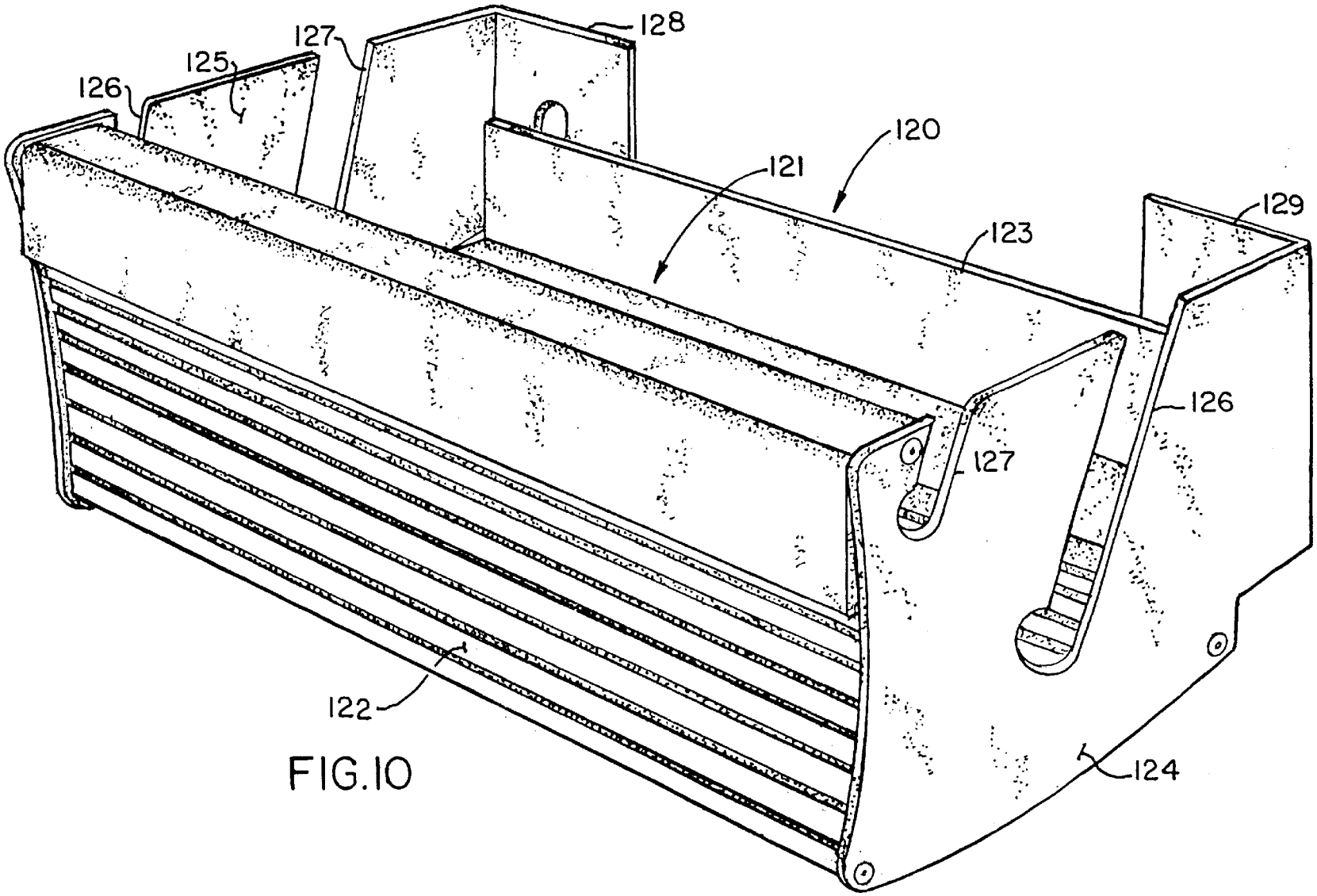
FIG. 10 is an isometric view of the horizontally extending electrical component and cable container for computer table.
Figure 11:
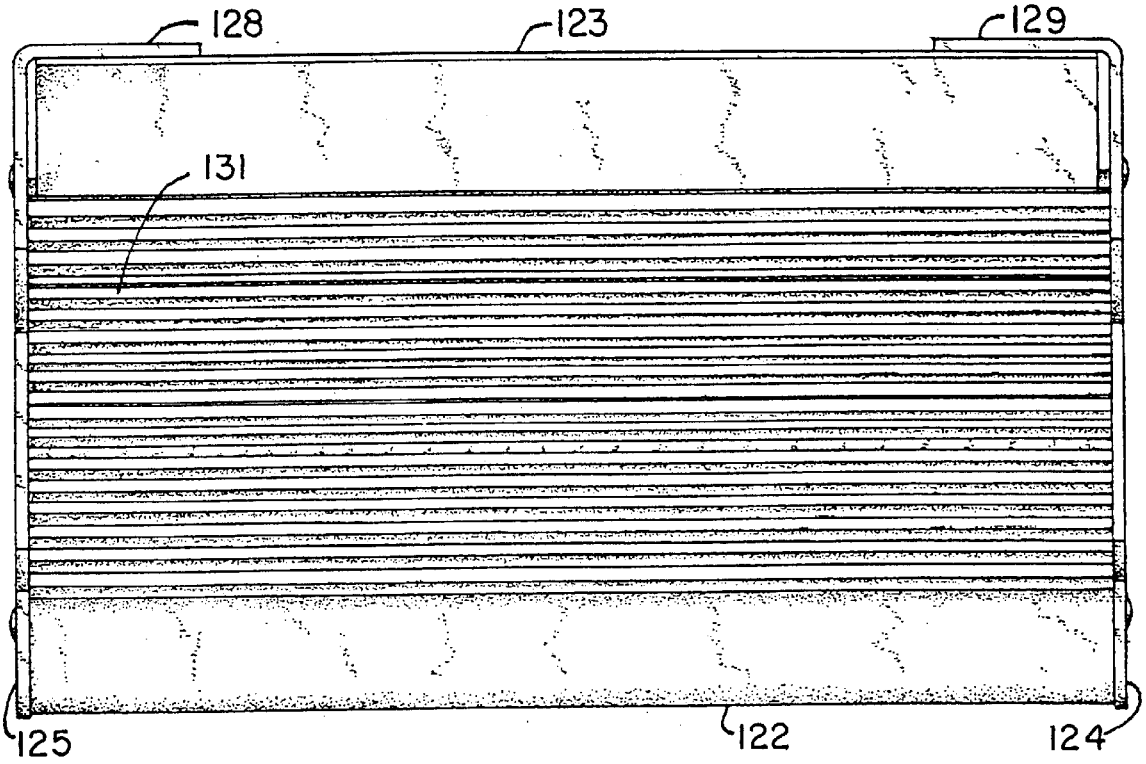
FIG. 11 is a top view thereof.
Figure 12:
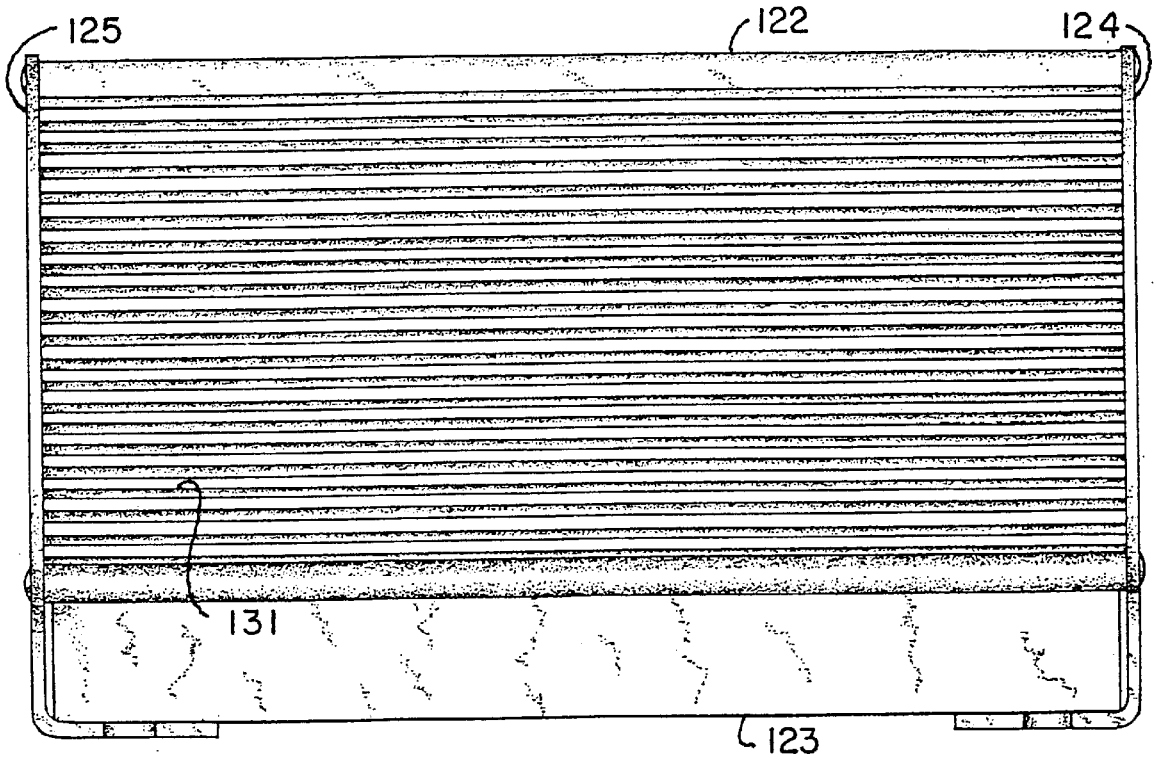
FIG. 12 is a bottom view thereof.
Figure 13:
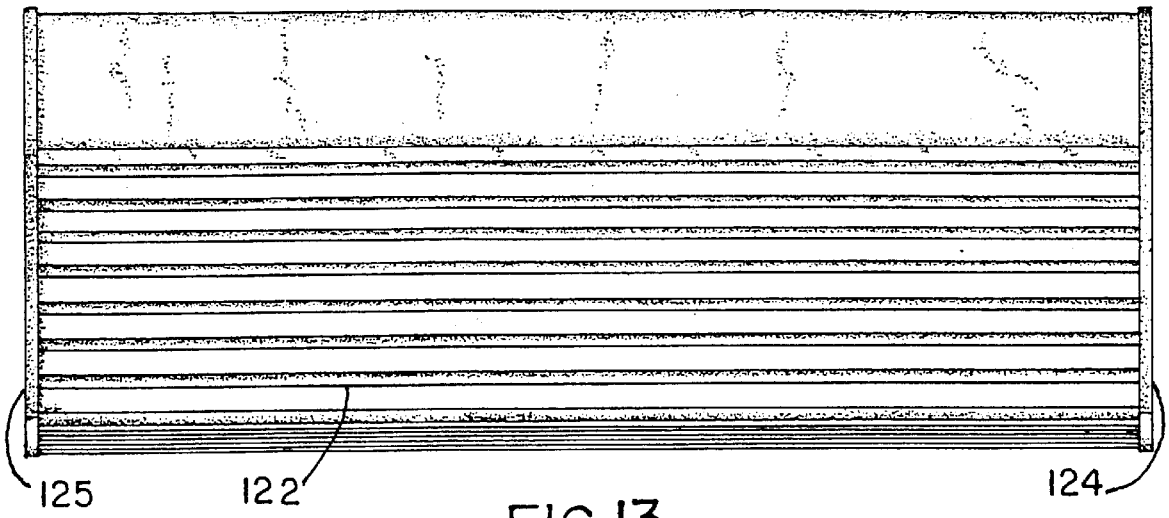
FIG. 13 is a front view thereof.
Figure 14:
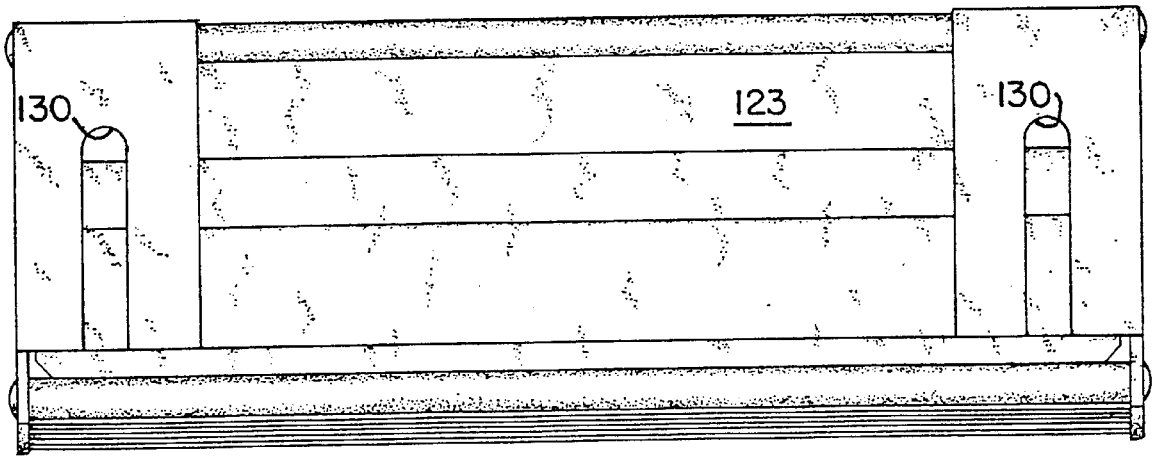
FIG. 14 is a rear view thereof.
Figure 15:
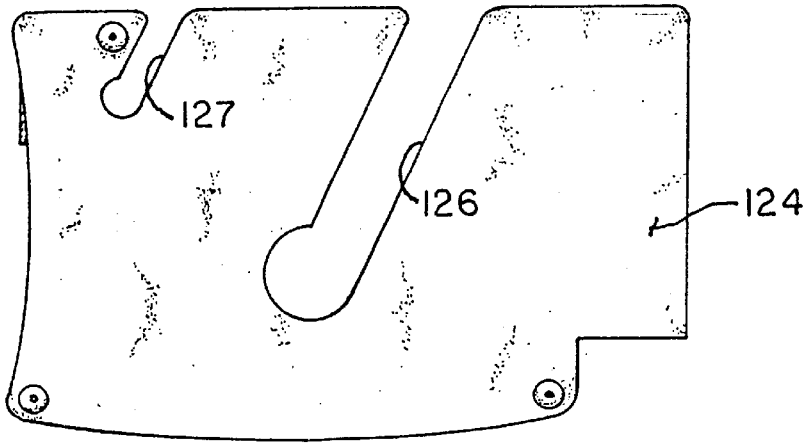
FIG. 15 is a right side view, the left side view being a mirror image thereof.

In referring to the drawings, and in particular FIG. 10, there is disclosed a horizontally extending electronic component and cable container for computer table. This device 120, may be mounted either to the front, or back edge, of a computer table, and contain the various cabling systems and electronic components needed to accessorize the computers used and applied upon the computer table (not shown). The container, which functions as a cable manager, includes a trough like member 121 formed of a front panel 122, a back panel 123 and a pair of side panels 124 and 125. The side panels or end walls include a series of slot sections 126 and 127, which form open-ended slot sections, so as to allow any of the large gauge of cables or wires to insert therethrough, during installation. Integrally bent from the back edges of the side walls 124 and 125 are the brackets 128 and 129, respectively, and which include slots 130 which allow for the installation of the container to one of the edges of the computer table, as previously explained.

It will be appreciated by those skilled in the art that various changes and modifications can be made in the cable manager of the present invention without departing from the scope of the appended claims. Therefore, the foregoing description and accompanying drawing are intended to be illustrative only and should not be construed in a limiting sense.

What is claimed is:

1. A cable manager for the attachment to the edge of a table for the containment of electric power cables associated with electronic devices resting on the table, the cable manager comprising:

a modesty panel, said modesty panel including a first end, a second end, an upper edge, and a lower edge;

a first integral bead retention channel at the upper edge of said modesty panel, at least one mounting bracket slidingly engaged in said first bead retention channel, a second integral bead retention channel at said lower edge of said modesty panel, a integral slide lock assembly adjacent said lower edge and spaced apart from said second bead retention channel; and a cable containment trough slidingly engaged in both said slide lock assembly and said second bead retention channel.

2. The cable manager of claim 1 wherein said modesty panel and said cable containment trough are formed from extruded metal.

3. The cable manager of claim 2 wherein said slide lock assembly further comprises a first outwardly disposed flange and a second opposed outwardly disposed flange.

4. The cable manager of claim 1 where in said modesty panel has a substantially arcuate profile and including a recurved overhang.

5. The cable manager of claim 1 wherein the modesty panel includes a first end cap removeably attached to said first end and a second end cap removeably attached to said second end.

6. A cable manager for the attachment to the edge of a table for the containment of electric power cables associated with electronic devices resting on the table, the cable manager comprising:

an electrical cable containment raceway, said raceway including a bottom wall, said bottom wall having a front edge and a rear edge, a rear wall extending upwardly from said rear edge of said bottom wall, a first end wall and a second end wall, said first and second end walls each having at least one aligned and complementary slot opening to an edge of said end walls formed therein for the introduction of electrical cables into said raceway;

a first mounting bracket on said first end wall and a second mounting bracket on said second end wall, said first and second mounting brackets disposed to allow removable attachment of said raceway to a table;

a torsion spring-actuated hinge at said front edge of said bottom wall; and a modesty panel attached to said hinge and moveable from an open position which allows access into said raceway to a closed position which closes off access into said raceway.

7. The cable manager of claim 6 wherein said modesty panel further includes an overhang along an upper edge thereof, said overhang disposed to serve as a handle when said modesty panel is moved from said open to said closed position or vice versa.

8. The cable manager of claim 6 wherein said modesty panel is formed from extruded aluminum.

9. The cable manager of claim 6 wherein said modesty panel has a first end cap at a first end and a second end cap at a second end.

10. The cable manager of claim 6 wherein the raceway further includes a wire duct.

11. The cable manager of claim 6 wherein said slot extending angularly towards an edge of the said end walls.

12. A cable manager for attachment to the edge of a table for the containment of electric power cables associated with electronic devices resting on the table, the cable manager comprising:

an electrical cable containment raceway, said raceway including a bottom wall, a front wall, and a back wall, said front and back walls attaching to said bottom wall, a first end wall, and a second end wall; said first and second end walls each having at least one aligned and complementary angled slot opening to an edge of said end walls formed therein for the introduction of electric cables into said raceway; a first mounting bracket on said first end wall, and a second mounting bracket on said second end wall, said first and second mounting brackets disposed perpendicularly to their respective end walls, and capable of removable attachment of said raceway to the edge of a table; and said cable manager including a cavity formed therein and into which the various cables may be arranged, for attachment to the electronic devices resting upon the table and to conduct electrical energy thereto.

13. The cable manager of claim 12 wherein said raceway extends horizontally from the edge of a table.

14. The cable manager of claim 12 wherein said raceway extends vertically downwardly from the proximate edge of the table.

15. The cable manager of claim 12 wherein said front, rear, and bottom walls are fluted for structural strength reinforcement purposes.

* * * * *